US008430646B2

(12) United States Patent
Shade et al.

(10) Patent No.: US 8,430,646 B2
(45) Date of Patent: Apr. 30, 2013

(54) VARIABLE VOLUME CLEARANCE POCKET FOR A RECIPROCATING COMPRESSOR CYLINDER

(75) Inventors: W. Norm Shade, Zanesville, OH (US); Richard Doup, Fredricktown, OH (US)

(73) Assignee: ACI Services, Inc., Cambridge, OH (US)

( * ) Notice: Subject to any disclaimer, the term of this patent is extended or adjusted under 35 U.S.C. 154(b) by 270 days.

(21) Appl. No.: 12/540,677

(22) Filed: Aug. 13, 2009

(65) Prior Publication Data

US 2010/0040484 A1 Feb. 18, 2010

Related U.S. Application Data

(60) Provisional application No. 61/088,527, filed on Aug. 13, 2008.

(51) Int. Cl.
*F04B 49/00* (2006.01)

(52) U.S. Cl.
USPC ..... 417/274; 417/212; 417/213; 92/60.5

(58) Field of Classification Search ..... 417/274, 417/212, 213; 92/60.5
See application file for complete search history.

(56) References Cited

U.S. PATENT DOCUMENTS

| | | | | |
|---|---|---|---|---|
| 1,997,476 | A * | 4/1935 | Wallene | 417/274 |
| 3,045,892 | A * | 7/1962 | White | 92/59 |
| 3,575,087 | A * | 4/1971 | Sherwood | 92/23 |
| 4,775,299 | A * | 10/1988 | Overfield et al. | 417/274 |
| 5,141,413 | A * | 8/1992 | Bennitt | 417/523 |
| 5,331,998 | A | 7/1994 | Sperry | |
| 5,564,906 | A | 10/1996 | Bennitt et al. | |
| 5,647,730 | A | 7/1997 | Woollatt | |
| 5,735,675 | A | 4/1998 | Peoples et al. | |
| 6,259,175 | B1 * | 7/2001 | Alfano et al. | 310/20 |
| 6,641,371 | B2 * | 11/2003 | Graziani et al. | 417/274 |
| 6,734,582 | B2 * | 5/2004 | Corbett et al. | 310/12.01 |

FOREIGN PATENT DOCUMENTS

JP 2163482 * 6/1990

* cited by examiner

*Primary Examiner* — Devon Kramer
*Assistant Examiner* — Thomas Fink
(74) *Attorney, Agent, or Firm* — Hasse & Nesbitt LLC; Ronald J. Richter; Daniel F. Nesbitt

(57) ABSTRACT

A controllable variable volume clearance pocket for reciprocating compressor cylinders is disclosed. The invention includes a device for varying the clearance volume of a variable volume clearance pocket in a controlled manner. The device can be used repeatedly to change the compressor cylinder clearance volume as required to control compressor capacity and power required from the compressor driver. The device is typically mounted on the outer or head end of a reciprocating compressor cylinder, but can also be scaled and configured for use either in conjunction with a variable clearance volume unloader operating over a reciprocating compressor valve pocket or a special port in a reciprocating compressor body.

16 Claims, 8 Drawing Sheets

VARIABLE VOLUME CLEARANCE POCKET FOR A RECIPROCATING COMPRESSOR CYLINDER

CROSS-REFERENCE TO RELATED APPLICATIONS

This application claims the benefit of U.S. Provisional Application 61/088,527, filed Aug. 13, 2008, the disclosure of which is incorporated herein by reference.

FIELD OF THE INVENTION

The present invention relates in general to reciprocating compressors, and in particular to reciprocating compressor cylinders having controllable variable volume clearance pockets, and to a device for varying the clearance pocket volume of the compressor cylinder in a controlled manner.

BACKGROUND OF THE INVENTION

Reciprocating compressors typically include one or more pistons that "reciprocate" within closed cylinders. They are commonly used for a wide range of applications that include, but are not limited to, the pressurization and transport of air, natural gas, and other gases and mixtures of gases through systems that are used for gas transmission, distribution, injection, storage, processing, refining, oil production, refrigeration, air separation, utility, and other industrial and commercial processes.

Reciprocating compressors are positive displacement machines wherein a reciprocating piston moves back and forth within a fixed cylindrical volume. As such the compressor's capacity is in direct relation to the fixed geometry built into the compressor cylinder(s). The capacity is a function of the compressor cylinder displacement, defined as the area of the piston end face multiplied by the length of the stroke of the piston and the fixed internal clearance volume remaining in the end of the cylinder when the piston is at the outer end of its stroke.

The compressor capacity can be changed by changing the internal clearance volume. There are various common means available for changing this clearance volume. One such device, often referred to as a fixed volume clearance pocket, typically adds a discrete amount of pocket clearance volume to the fixed internal clearance volume that is switched on or off by an actuating device, either manually or automatically.

Another device, commonly referred to as a variable volume clearance pocket, is often located in and on the compressor cylinder outer head. This device incorporates an internal clearancing piston that can be manually moved, using a screw mechanism, to add clearance volume to, or subsequently remove clearance volume from, the head end fixed internal clearance volume. Adding clearance volume reduces the compressor capacity, and removing clearance volume increases the compressor capacity.

Since the required power for the compressor is directly dependent on the capacity of the compressor, such devices are commonly referred to as unloaders, which can reduce the capacity and therefore "unload" the compressor; or they can increase the capacity and therefore "load" the compressor. The variable volume clearance pocket is one of the most effective means of changing the compressor capacity and the required power because it can be positioned at an infinite number of positions or steps within the range of fixed clearance volumes that it is designed to add. Such devices have been in use throughout the compressor industry for many years.

In many compressor applications, conditions change often and sometimes fairly rapidly. It is therefore desirable, for optimal efficiency and utilization of the compressor, to adjust the position of the variable volume pocket's clearancing piston to accommodate changes in operating conditions, for example suction pressure, suction temperature, discharge pressure, gas composition, available driver power, required capacity or flow rate, or other condition changes. Changes in these operating conditions typically affect the capacity and required power of the compressor. For example, in many cases, upsets or sudden increases in suction pressure make it critically important to add fixed volumetric clearance quickly in order to reduce the compressor's capacity and required power and thus prevent damage to the compressor and driver from overload or from operating outside other permissible or safe operating conditions. Changes in operating conditions may also be needed in order to prevent shutdown, for example by a system that is designed to prevent overload of the compressor or driver.

Generally, however, it is not practical and sometimes not physically possible to manually move the variable volume clearancing pocket piston in response to such changes in operating conditions. First, the internal compression pressures can create large forces that make the clearancing piston difficult to move manually, even with a large wrench or hand-actuated wheel for leverage. Second, because of vibration and motion of the compressor cylinder during operation, and the operator's need to be close to the operating equipment in order to move the clearancing piston, it is often a dangerous, or at least threatening, proposition to manually move the clearancing piston while the compressor is running. In fact, many companies do not permit their operators to move the clearancing piston while the compressor is running. Third, before changing the position of the clearancing piston, it is important to know what effects the changes will have on the compressor. Information such as performance curves or other operating guidance is not often available to the operator to enable a safe resetting of the clearancing piston position while the compressor is operating.

Fourth, few compressors are attended by an operator at all times of the day or night, making it impractical to be aware of the need to move the clearancing piston and then to move the clearancing piston in order to unload or load the compressor. Fifth, moving the clearancing piston requires breaking loose a typically large jam nut that locks the screw threads on the manual actuator stem and overrides the cyclic loading imposed on the threads by the cyclic compressor cylinder pressure. The jam nut prevents movement of the clearancing piston, but must be released before the clearancing piston can be moved. Then, after the clearancing piston is moved to the desired setting, the jam nut must again be locked securely to keep the clearancing piston from movement caused by vibration and cyclic pressures acting on the clearancing piston and actuator stem threads.

In virtually all applications, when compressors shut down unintentionally, revenue is lost. In some cases the effects of a compressor shutting down at the wrong time can have catastrophic results when the compressor is part of a complex process. Once shut down, restarting a compressor can take anywhere from minutes to a day or more to restart it, depending on the complexity of the application, remoteness of the location, and other factors. Therefore it is very common practice to set and lock the clearancing piston in a position where the compressor and driver are unlikely to be overloaded during high pressure upsets or process excursions. Although this practice provides a conservative operating margin that usually protects the compressor and driver from damage or overloading during upsets, it subsequently results in underloading and underutilization much of the time.

Therefore, there is an important need for a device and means to automatically move the clearancing piston in a manner that is safe, accurate, reliable and effective, while the compressor is operating. With the development of advanced reciprocating modeling software, which is available from some of the current compressor manufacturers and from the inventors' company, it has been possible and increasingly common practice to automatically control compressors by using control algorithms programmed into digital computers or programmable logic controllers to operate one or more cylinder clearancing devices or cylinder end deactivators to control the capacity produced and the power required by the compressor.

Most of the automatically controllable clearancing devices in common use are discrete step devices that add or remove a fixed amount of clearance volume to the internal clearance volume. Although there are several automatic variable or so called infinite step devices that are used in some limited applications, these devices tend to be more complicated, more expensive and less reliable than the automatically controlled discrete step devices, making their use less acceptable and less prevalent than the industry's needs otherwise require, especially in light of high energy and compressed product values.

More specifically, automatic variable volume clearancing devices that are hydraulically actuated have major disadvantages that limit their use. First the hydraulically actuated devices require a hydraulic actuator and a hydraulic pressure delivery system. Hydraulic oil is usually not desirable around compressors because of the concern about leaks or ruptures of lines and hoses, which could cause environmental contamination and fires. In addition, the potential leakage of hydraulic fluid past seals into the process gas is undesirable and often unacceptable. Finally, hydraulic fluid or other liquids are not perfectly incompressible, especially at higher pressures exceeding about 1000 psig. This typically results in minute oscillation of the unloader piston and actuating system, leading to premature wear of sealing elements and leakage of process gas or hydraulic fluid that results in downtime, frequent maintenance and risk of environmental contamination.

In light of this, an important need remains for a reliable, cost-effective actuating device for automatically controlling the position of the clearancing piston in a variable volume clearance pocket without direct human assistance and without a hydraulic fluid actuator system.

SUMMARY OF THE INVENTION

Accordingly, the present invention relates to a device for controlling the clearance volume of a variable volume clearance pocket within a reciprocating compressor cylinder. Existing devices are typically manually actuated or are actuated automatically via the use of a hydraulic actuator and accompanying fluid pressurization and control system. The present invention has many of the same features as the manual actuator, but it is positioned, locked and moved without the use of a hydraulic fluid delivery system or direct manual assistance.

A first aspect of the invention provides a device for varying the clearance volume of a variable volume clearance pocket, the device comprising: (a) a main housing having a gear end and a piston end; (b) a gear housing mounted to the gear end of the main housing, the gear housing including a drive gear; (c) a head mounted to the piston end of the main housing and adapted to sealably fit within the outer end of a reciprocating compressor cylinder, the compressor cylinder including a compressor piston and a variable volume clearance pocket, the clearance pocket formed between the compressor piston and the outer end of the compressor cylinder; (d) a clearancing piston located within the head of the device and adapted to be movable therein, movement of the clearancing piston operable to vary the volume of the clearance pocket within the compressor cylinder; (e) a threaded stem having a drive engagement end and a piston end, the piston end of the threaded stem rigidly connected to the clearancing piston; (f) a drive shaft having a gear end and a drive engagement end and adapted to be turned by the drive gear, the gear end of the drive shaft attached to the drive gear, the drive engagement end of the drive shaft adapted to engage the drive engagement end of the threaded stem, the drive shaft being operable to advance or slide into or retreat out of the threaded stem as the drive shaft is turned by the drive gear, thereby causing the threaded stem and clearancing piston to withdraw from the head or advance within the head, respectively; and (g) a pressure-actuated jam nut for biasing or locking the threaded stem in a static position and for unbiasing or unlocking the threaded stem to allow movement thereof, wherein when the jam nut is unlocked the threaded stem and the clearancing piston can be advanced outward and inward, and wherein movement of the clearancing piston within the head allows the volume of the clearance pocket to be varied in a controlled manner.

A second aspect of the invention provides a reciprocating compressor having a controllable variable volume clearance pocket, the compressor comprising: (a) at least one reciprocating compressor cylinder, each of the at least one compressor cylinders including a compressor piston and a variable volume clearance pocket, the clearance pocket formed between the compressor piston and the outer end of the compressor cylinder; and (b) the aforementioned device for varying the clearance volume of the variable volume clearance pocket.

A third aspect of the invention provides a reciprocating compressor having a controllable variable volume clearance pocket, the compressor comprising: (a) at least one reciprocating compressor cylinder, each of the at least one compressor cylinders including a compressor piston and a variable volume clearance pocket, the clearance pocket formed between the compressor piston and the outer end of the compressor cylinder; and (b) a device for varying the clearance volume of the variable volume clearance pocket, the device comprising: (i) a housing including a gear end and a piston end, the housing including a drive gear; (ii) a head mounted to the piston end of the housing and adapted to sealably fit within the outer end of the compressor cylinder; (iii) a clearancing piston that creates a seal and is movable within the head, movement of the clearancing piston operable to vary the volume of the clearance pocket within the compressor cylinder; (iv) a threaded stem having a drive engagement end and a piston end, the piston end of the threaded stem rigidly connected to the clearancing piston; (v) a drive shaft having a gear end and a drive engagement end and adapted to be turned by the drive gear, the gear end of the drive shaft attached to the drive gear, the drive engagement end of the drive shaft adapted to drivably engage the drive engagement end of the threaded stem, rotation of the drive shaft being operable to cause the threaded stem to advance over the drive shaft and towards or away from the gear end of the housing, thereby causing the threaded stem and clearancing piston to withdraw from the head or advance within the head, respectively; and (vi) a pressure-actuated jam nut for biasing the threaded stem in a static position and for unbiasing the threaded stem to allow movement thereof, wherein when the jam nut is unbiased the threaded stem and the clearancing piston can be advanced outward and inward, and wherein movement of the clearancing piston within the head allows the volume of the clearance pocket to be varied in a controlled manner.

Typically the drive engagement end of the drive shaft is adapted to drivably engage the drive engagement end of the threaded stem by way of an engagement means. This engagement means can be male polygons, splines, keys, and squares. Further, the drive engagement end of the threaded stem typically includes a long bore which is adapted to engage the drive engagement end of the drive shaft by way of compatible engagement means, including matching female polygons, splines, keyways, and squares.

Typically the clearancing piston creates a seal interface with the cylindrical bore of the head, and is caused to advance or withdraw within the head as the drive shaft rotates within the threaded stem. For example, when the drive shaft rotates in a first direction that causes it to advance into the threaded stem, the threaded stem and thus the clearancing piston are advanced towards the drive gear in a direction along the drive shaft that causes the clearancing piston to withdraw within the head, thereby increasing the clearance volume of the compressor cylinder. When the drive shaft rotates in the opposite direction it will retreat out of the threaded stem, causing the clearancing piston to advance away from the drive gear in a direction along the drive shaft that causes the clearancing piston to advance further into the head, thereby decreasing the clearance volume of the compressor cylinder.

The drive gear typically includes a drive motor and a pinion gear and shaft assembly, and the drive shaft is attached near its gear end to the drive motor via the pinion gear and shaft assembly. Further, the device can include a controller programmed to operate the drive motor, and a position encoding device for tracking the position of the clearancing piston and providing a feedback signal to the controller. The pressure-actuated jam nut typically includes at least one pressure disc operable to pressurize and lock the jam nut to the threaded stem, and the pressure generated by the pressure source that activates the pressure disc can be multiplied by the use of an amplifier. Also, rotation of the pressure-actuated jam nut is typically prevented by at least one anti-rotation pin.

The nature and advantages of the present invention will be more fully appreciated from the following drawings, detailed description and claims.

BRIEF DESCRIPTION OF THE DRAWINGS

The accompanying drawings illustrate embodiments of the invention and, together with a general description of the invention given above, and the detailed description given below, serve to explain the principles of the invention.

DETAILED DESCRIPTION OF THE INVENTION

As defined herein, the term "capacity" means the total flow rate, throughput, or output of a compressor cylinder.

The present invention is a reciprocating compressor having a controllable variable volume clearance pocket. The compressor includes a device for varying the clearance volume of a variable volume clearance pocket in a controlled manner. The device can be used repeatedly to change the compressor cylinder clearance volume as required or desired, in order to control the compressor capacity and power required from the compressor driver. The device is typically mounted on the outer or head end of a reciprocating compressor cylinder.

A quick explanation of a few basic thermodynamic principles is necessary to understand the science of reciprocating compressors. Compression occurs within the cylinder as a four-part cycle that occurs with each advance and retreat of the piston (two strokes per cycle). The four parts of the cycle are compression, discharge, expansion and intake. They are shown graphically with pressure vs. volume plotted in what is known as a P-V diagram. See FIG. 8.

Figure 8:
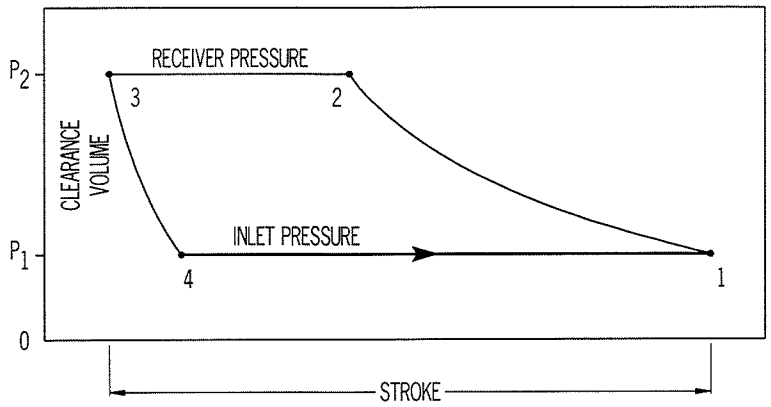
FIG. 8 is a typical Pressure-Volume (P-V) curve, as known in the art.

At the conclusion of a prior cycle, the piston is fully retreated within the cylinder at a first volume, represented by point 1 in FIG. 8, the volume of which is filled with process gas at suction conditions (at a first pressure, P1, and a first temperature), and the suction and discharge valves are all closed. As the piston advances, the volume within the cylinder is reduced. This causes the pressure and temperature of the gas to rise until the pressure within the cylinder reaches the pressure of the discharge header. At this time, the discharge valves begin to open, noted on the diagram by point 2. With the discharge valves opening, pressure remains fixed at P2 for the remainder of the advancing stroke as volume continues to decrease for the discharge portion of the cycle. The cycle is now at point 3. The piston comes to a momentary stop at the most advanced position in its travel before reversing direction.

Note that some minimal volume remains, known as the clearance volume. It is the space remaining within the cylinder when the piston is at point 3, after the compressed gas is discharged from the cylinder. Some minimum clearance volume is necessary to prevent piston/head contact, and the manipulation of this volume is a major compressor performance parameter. As the piston begins its return stroke, the gas which remains in this space re-expands to slightly below suction pressure.

Expansion is facilitated by the closing of the discharge valves and the retreat of the piston before a fresh charge of gas at suction conditions is admitted into the cylinder to be compressed. This is point 4. When P1 is reached, the intake valves open, allowing the fresh charge to enter the cylinder for the intake and last stage of the cycle. Once again, pressure remains essentially constant as the volume is changed. This marks the return to point 1. Comprehending this cycle is fundamental to diagnosing compressor problems, and to understanding compressor efficiency, power requirements, valve operation, etc. This knowledge can be gained by trending process information and monitoring the effect these items have on the cycle.

Common manually-actuated variable volume clearance pockets can be used to adjust the clearance volume over a predetermined range. The addition of clearance volume reduces the capacity or throughput and power consumption of the compressor, and removing clearance volume increases capacity and power consumption. A head-end (the amount of clearance volume that can be added at the outer or head end of the cylinder is generally much greater than what can be added at the inner or crank end of the cylinder) manually-actuated variable volume clearance pocket is an effective capacity and load control device. But since it must be operated manually, usually with the compressor shut down, a manually-actuated variable volume clearance pocket is not suited for automatic control of a compressor.

The present invention functions similarly to the typical head-end manually-actuated variable volume clearance pocket; however, it overcomes the limitations that heretofore have made it impractical and generally impossible to automate the operation of a device very similar to the manual device. Specific features of the present invention used either individually or in combination to make the device effective, include the following:

(1) A clearancing piston threaded stem that accepts a telescoping internal drive shaft to reduce the overall length of the assembly to reduce the cost and susceptibility to mechanical vibration. (2) A drive and pinion gear combination that involves connecting the large drive gear to the threaded stem connected to the clearancing piston and connecting the smaller pinion gear to a drive motor, this achieving a significant mechanical advantage that permits the use of a relatively smaller, higher speed, lower torque device to turn a relatively larger, lower speed, high torque threaded stem connected to the clearancing piston. (3) A pressure-actuated jam nut that locks, either automatically or by manual manipulation thereof, the clearancing piston threaded stem screw to hold it in a fixed position and to eliminate potentially damaging cyclic loading of the screw threads, turning gears and drive motor when the drive system is not in use. (4) A device to measure the position of the clearancing piston with a feedback signal to a control system. (5) A robust integrated one-piece housing to resist vibration and deflection and to provide adequate strength and stiffness in a reasonably compact and cost-effective assembly. (6) A pressure amplifier, that compresses a trapped liquid volume, is used to boost the pneumatic pressure that is produced by generally available plant air systems or from industrial air compressor units to a higher actuating pressure required for the clamping and locking function of the pressure-actuated jam nut. (7) Use of one of the following driving means: a pneumatic air motor, an electric motor, a hand crank, a hydraulic motor or other driving means connected to the pinion gear to provide the required torque for turning the clearancing piston threaded stem to cause the movement of the clearancing piston to a desired position. (8) A pressure compensation system for changing the pressure behind the back side of the clearancing piston to reduce the force acting on the piston and therefore the amount of torque required to move the clearancing piston threaded stem. This involves connecting the space on the back side of the clearancing piston to discharge pressure when it is to be moved inward toward the compressor cylinder to load the compressor, and connecting the space on the back side of the clearancing piston to suction pressure when it is to be moved outward away from the cylinder to unload the compressor.

Figure 1A:
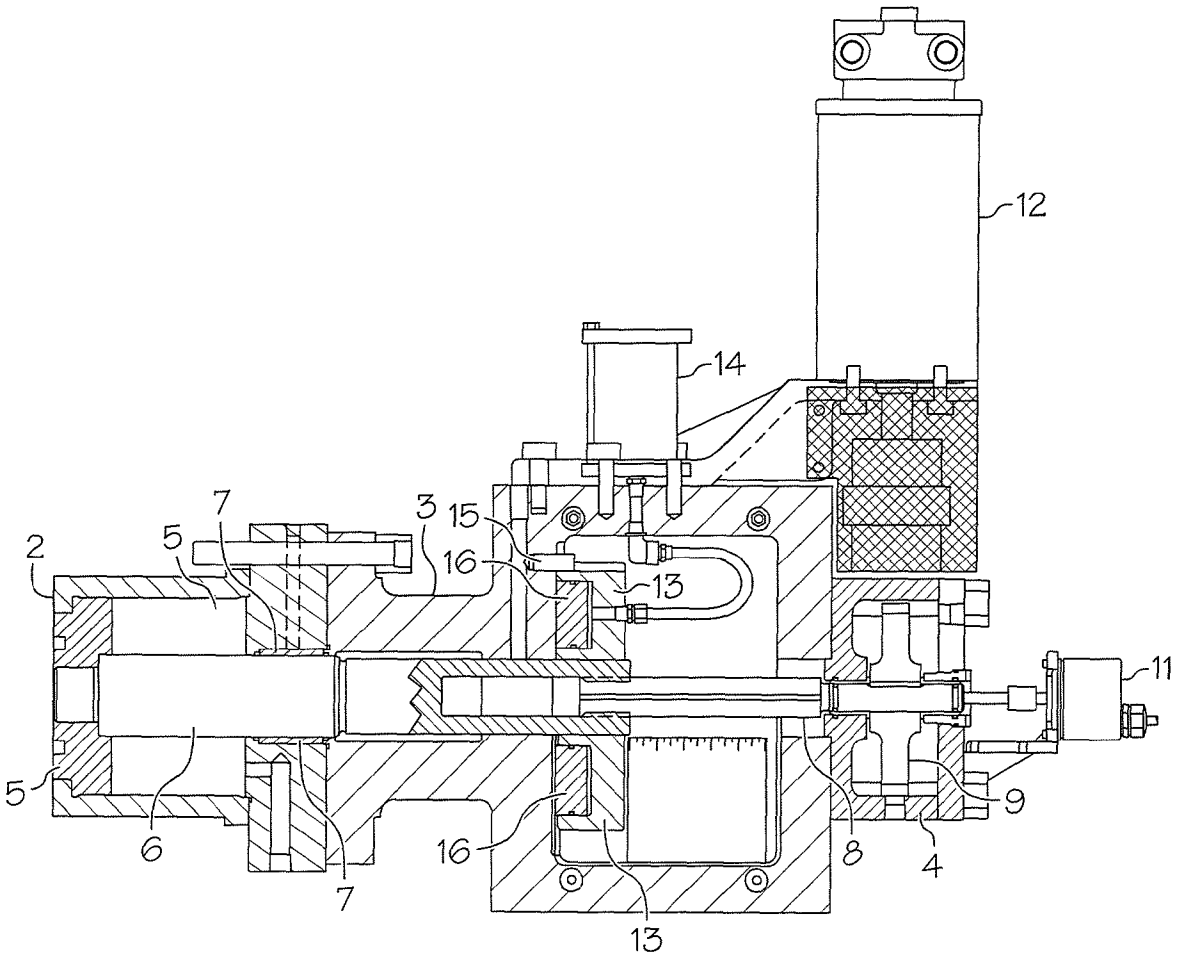
FIG. 1A is a cross-sectional view of an example of the present invention showing the clearance piston (5) and the threaded stem [6] at the extreme inward end of travel.
Figure 1C:
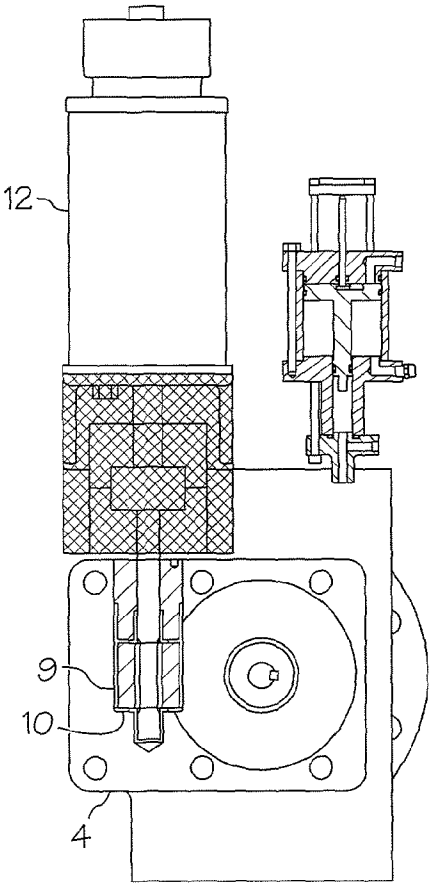
FIG. 1C is an end view of FIGS. 1A and 1B as seen from the gear housing end.

Referring to FIG. 1, the present invention consists of a head [2] which is mounted at the outer or head-end of a reciprocating compressor cylinder. The head [2] typically contains a sleeve bearing [7] and is attached to a main housing [3], to which is mounted a gear housing [4]. Inside the head [2] is a clearancing piston [5] that is rigidly connected to one end of a threaded stem [6], which is supported and aligned within the assembly by the sleeve bearing [7]. The sleeve bearing [7] can be made of either a self-lubricated material or of a material requiring a lubricant. As a non-limiting example, the sleeve bearing can be made of oil, grease, Teflon, graphite or other substance. The other end, or drive engagement end, of the threaded stem [6] has a long bore into which a drive shaft [8] engages. The bore in the threaded stem [6] and the driving section of the drive shaft [8] typically have a matching female and male form, respectively. This form may be a polygon, a spline, a square, a key and slot, multiple keys and slots, or any other form of mating drive geometry. The drive shaft [8] is typically supported by bearings, and is attached to and driven by the drive gear [9].

Typically the clearancing piston [5] creates a seal interface with the cylindrical bore of the head [2], and the clearancing piston [5] is caused to advance or withdraw within the head [2] as the drive shaft [8] rotates within the threaded stem [6]. The inner, or drive engagement end of the drive shaft [8], when rotated by the motorized drive gear, is caused to advance or slide into the threaded stem [6] when turned in a first direction, or conversely retreat or slide out of the threaded stem [6] when the drive shaft is turned in a second or opposite direction. This rotation of the drive shaft [8] also causes the threaded stem [6] and clearancing piston [5] to rotate, their rotation causing them to move axially along the drive shaft, this movement causing them to be withdrawn from the head [2] when the shaft is turned in the first direction, and advanced or moved inward within the head [2] when the shaft is turned in the second direction, respectively.

More specifically, rotation of the drive shaft is operable to cause the threaded stem to rotate about the drive shaft and axially advance or slide over the drive shaft either towards the gear end of the housing (if the drive shaft rotates in a first direction) or away from the gear end of the housing (if the drive shaft rotates in a second direction) as the drive shaft is turned by the drive gear. In this manner, when the drive shaft rotates in the first direction the threaded stem and thus the clearancing piston are advanced towards the drive gear in a direction along the drive shaft that causes the clearancing piston to withdraw away from the outer end of the cylindrical bore of the head, thereby increasing the clearance volume of the compressor cylinder. Conversely, when the drive shaft rotates in the opposite direction the threaded stem will advance away from the drive gear, causing the clearancing piston to advance away from the drive gear in a direction along the drive shaft that causes the clearancing piston to advance towards the outer end of the head, thereby decreasing the clearance volume of the compressor cylinder. In any event, the threaded stem and the clearancing piston are caused to axially advance and/or retreat as the drive shaft rotates in place, in either a clockwise or counterclockwise direction.

Figure 1B:
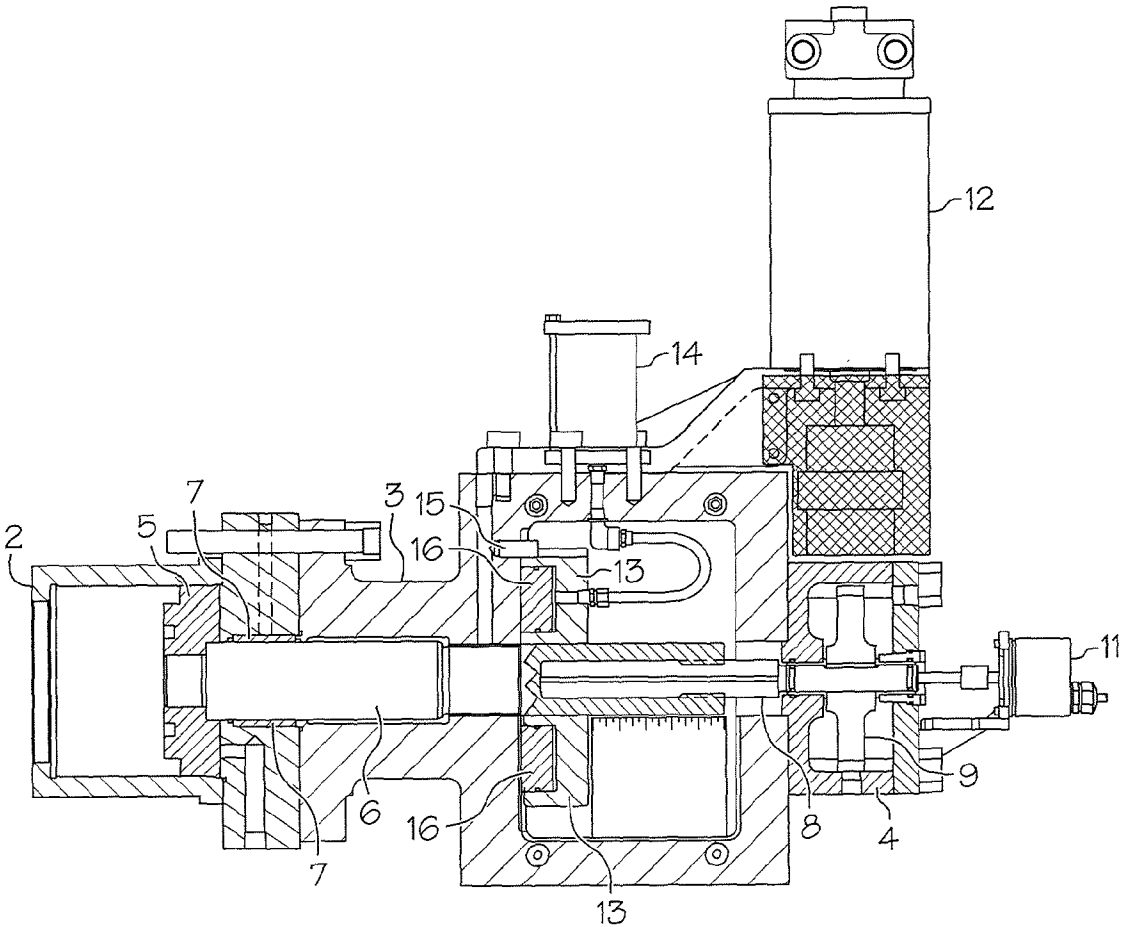
FIG. 1B is the cross-sectional view of FIG. 1A showing the clearance piston (5) and the threaded stem [6] at the extreme outward end of travel.

The cross-section of the clearancing piston [5] and threaded stem [6] in FIGS. 1A and 1B show both positions at the extreme inward (FIG. 1A) and outward (FIG. 1B) ends of travel. The clearancing piston [5] and threaded stem [6] in FIG. 1B shows the assembly at the extreme outward end of its travel, which is typical of the minimum loaded or maximum unloaded position, while FIG. 1A shows the clearancing piston [5] and threaded stem [6] assembly at the extreme inward end of its travel, which is typical of the maximum loaded or minimum unloaded position.

The outer gear end of the drive shaft [8] can be attached to a position encoding device or encoder [11] that is used to track the position of the clearancing piston and provides a feedback signal to an indicator or controller. The drive gear [9] is typically turned by a small pinion gear and shaft assembly [10] that is coupled to a drive motor [12] which may be powered by a pressurized source of air, gas, or other fluid, or by electricity. A pressure-actuated jam nut [13] is caused to bias against and thus lock the threaded stem [6] in place when the threaded stem is to be held in a static position. The pressure-actuated jam nut employs one or more internal pistons, typically in the form of a pressure disc [16] that is pressurized with a relatively higher fluid pressure. The relatively higher fluid pressure is generated by the use of an amplifier [14] to which is connected an air pressure. Pressure is applied to the system for locking, and is relieved from the system when it is necessary for the drive motor to move the clearancing piston in response to an automatic control or to a manual signal. Rotation of the pressure-actuated jam nut is prevented by one or more anti-rotation pins [15].

Figure 2:
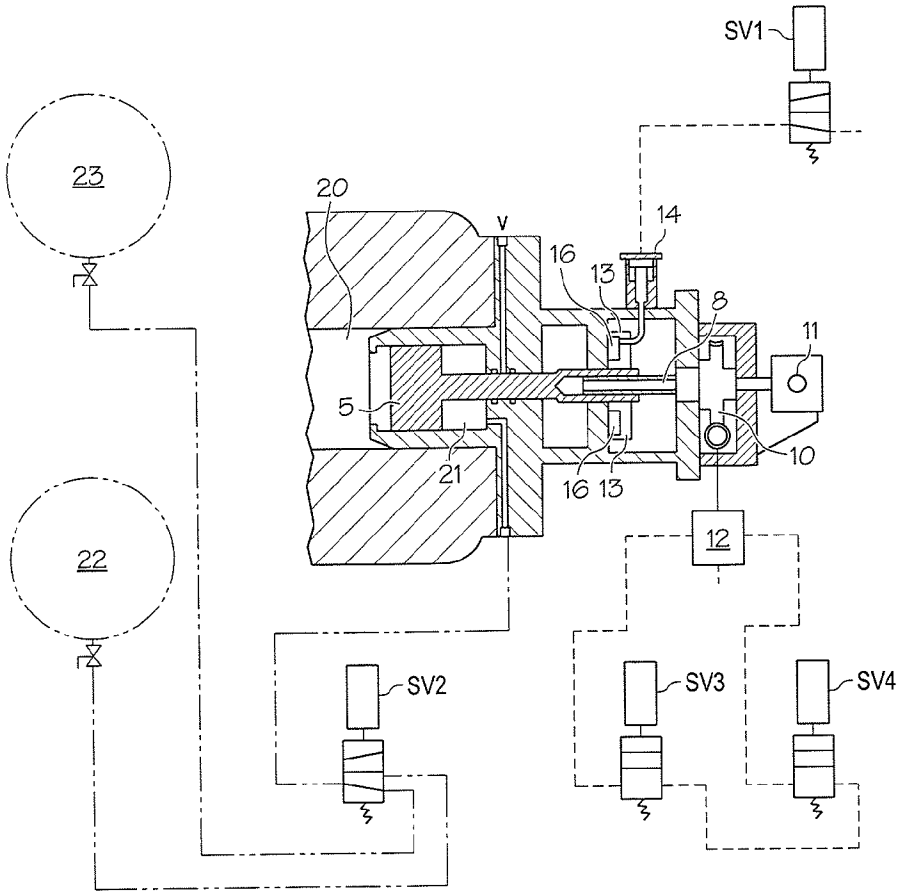
FIG. 2 is a schematic view of the present invention and operating sequence.

Referring to FIG. 2, the operation of the present invention is explained. When it is desirable to unload the compressor by increasing the added clearance volume, the clearancing piston [5] is moved outward away from the compressor cylinder [20]. Solenoid SV2 is de-energized to connect the compensating gas chamber [21] behind the clearancing piston to compressor suction pressure. This permits suction gas to flow into the space behind the clearancing piston [5] to equalize to the pressure level of the suction gas header [23]. This permits the cyclic discharge pressure in the cylinder to assist in moving the clearancing piston outward, reducing the amount of force required to move the clearancing piston and thus the torque required from the drive motor [12] and gear [10] to turn the drive shaft [8] within the threaded stem [6]. Solenoid SV1 is energized allow the pressure in the pressure-actuated jam nut [13] to reduce to near atmospheric pressure to allow the pressure disc [16] to unclamp the threaded stem so that the threaded stem [6] and the clearancing piston [5] can rotate as the assembly is turned by the drive motor. For the case of a pneumatic drive motor, solenoid SV3 is energized to admit pressure to turn the drive motor [12] in a counter clockwise direction that moves the clearancing piston [5] away from its innermost position until it is desirable to stop at a new position.

When a new position or controller set point is reached, as indicated by the feedback signal from the position encoder [11], solenoid SV3 is de-energized to stop the drive motor [12] from turning, and solenoid SV1 is de-energized to allow pressure to actuate the amplifier [14] and subsequently the pressurized jam nut [13] to load and lock the threaded stem.

When it is desirable to load the compressor by decreasing the added clearance volume by moving the clearancing piston [5] inward toward the cylinder [20], solenoid SV2 is energized to connect the compensating gas chamber [21] behind the clearancing piston to compressor discharge pressure. This permits discharge gas to flow into the space behind the clearancing piston [5] to equalize to the pressure level of the discharge header [22]. The discharge pressure then assists in moving the clearancing piston inward, reducing the amount of force required to move the clearancing piston and thus the torque required from the drive motor and gear to turn the threaded stem.

Solenoid SV1 is energized allow the pressure in the pressure-actuated jam nut [13] to reduce to near atmospheric pressure to allow the pressure disc [16] to unclamp the threaded stem so that the threaded stem [6] and the clearancing piston [5] can rotate as the assembly is turned by the drive motor. For the case of a pneumatic drive motor, solenoid SV4 is energized to admit pressure to turn the drive motor in a clockwise direction that moves the clearancing piston toward its innermost position until it is desirable to stop at a new position.

When a new position or controller set point is reached, as indicated by the feedback signal from the position encoder [11], solenoid SV4 is de-energized to stop the drive motor from turning, and solenoid SV1 is de-energized to allow pressure to actuate the multiplier and subsequently the pressurized disc [16] to load and lock the threaded stem.

Figure 3:
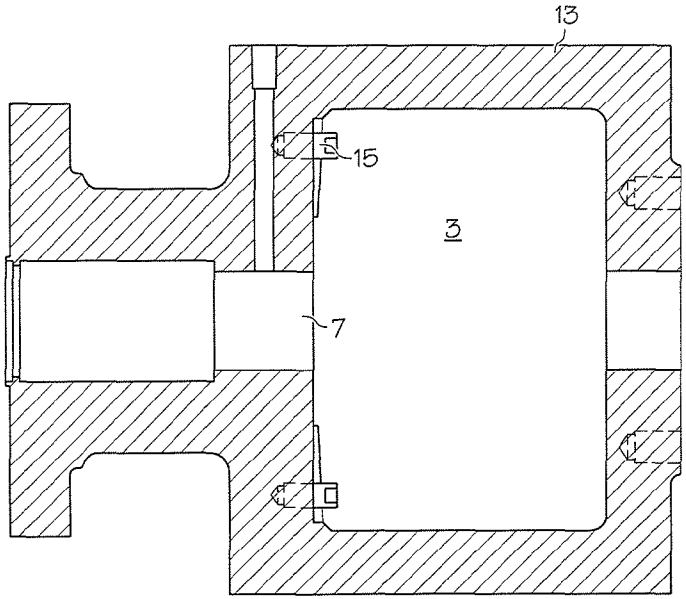
FIG. 3 is a cross-sectional view of the main housing of the present invention.

Referring to FIG. 3, the detail of an embodiment of a main housing [3] of the present invention is further provided to show the detail of the threaded bore that threadably engages the threaded stem [6] and the anti-rotation pins [ 15] that prevent rotation of the pressure-actuated jam nut [13].

Figure 4A:
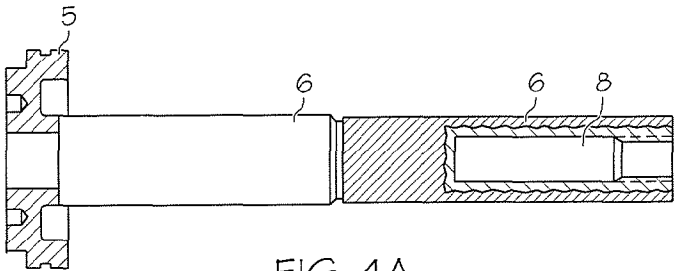
FIG. 4A is a cross-sectional view of the clearancing piston and threaded stem of the present invention.
Figure 4B:
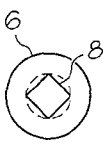
FIG. 4B is an end view of FIG. 4A showing the profile of the drive shaft within the circular threaded stem.

Referring to FIG. 4, the detail of the clearance piston [5] and threaded stem [6] is further provided to show the detail of the external threads that engage the threaded bore of the main housing [3] and the detail of the threaded stem [6] bore that engages the drive shaft [8].

Figure 5:
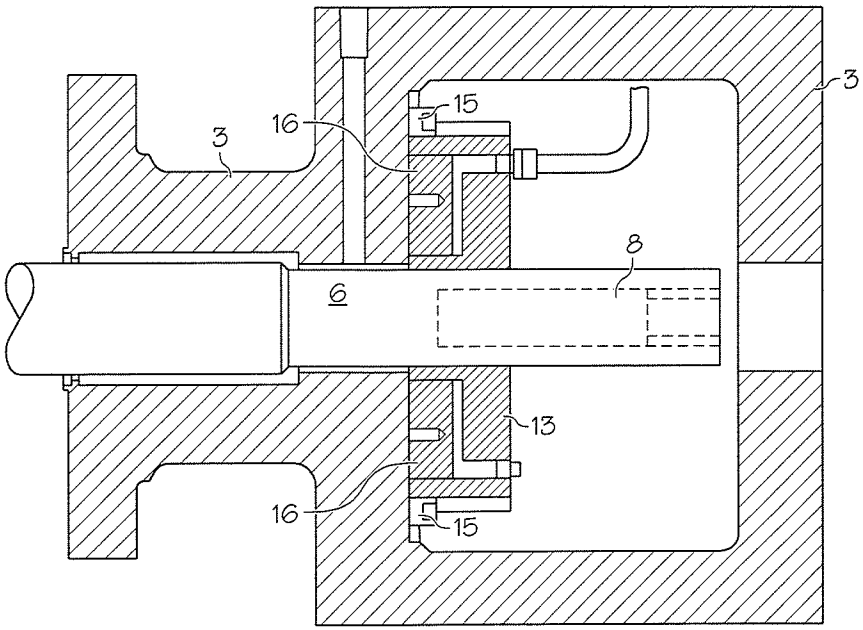
FIG. 5 is a cross-sectional view of the pressure-actuated jam nut of the present invention.

Referring to FIG. 5, the detail of the pressure-actuated jam nut [13] is further provided to show its engagement with the threaded stem [6], the pressure disc [16] inserted within and sealed with one or more o-rings, cup seals, or other sealing elements to prevent leakage of the hydraulic pressure from the pressure-activated jam nut [13], within the pressure-actuated jam nut [13] and the engagement of the anti-rotation pins [15] with the pressure-actuated jam nut [13].

Figure 6:
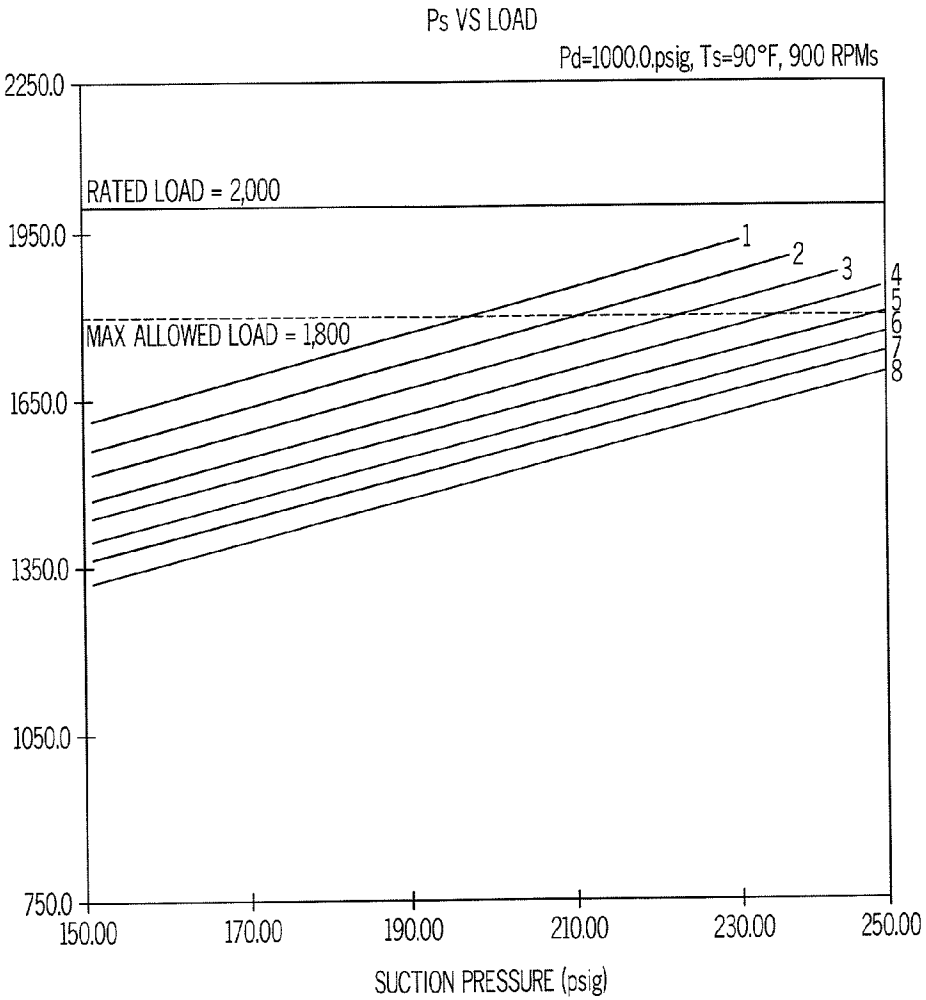
FIG. 6 is a graph plotting the power or load required by a reciprocating compressor as a function of suction or inlet pressure at a constant speed and constant discharge, or as a function of outlet pressure from the compressor cylinder.
Figure 7:
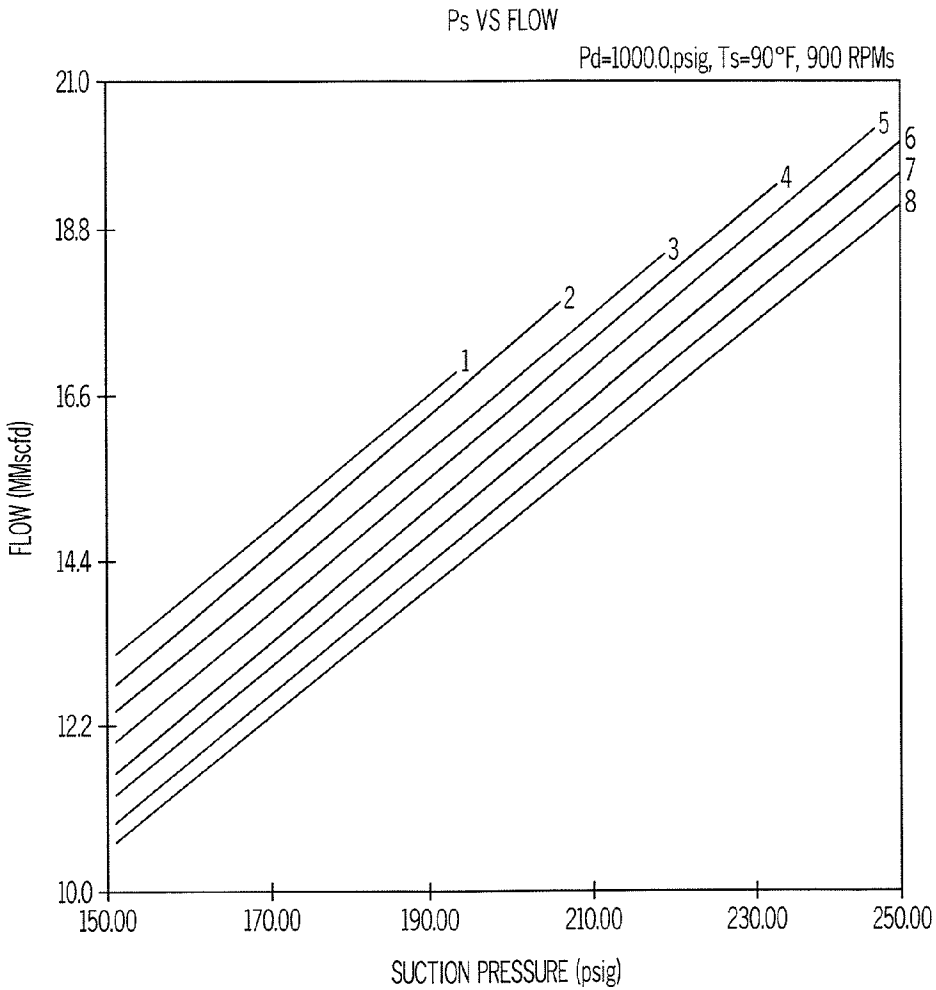
FIG. 7 is a graph plotting the corresponding effects of the variable volume clearance pocket on the compressor flow rate.

FIGS. 6 and 7 illustrate the effects that device of the present invention has on the performance of a reciprocating compressor. FIG. 6 shows plot of power or load, measured in brake horsepower, required by a reciprocating compressor as a function of suction or inlet pressure, measured in psig, at a constant speed and constant discharge or outlet pressure from the compressor cylinder. Line 1 represents the load that is required by the compressor when the variable volume clearance pocket is set at its maximum loaded or minimum unloader condition, as characterized by the clearancing piston being at the extreme inward position as shown in FIG. 1A. Line 8 represents the load that is required by the compressor when the variable volume clearance pocket is set at its minimum loaded or maximum unloader condition, as characterized by the clearancing piston being at the extreme outward position as shown in FIG. 1B. Lines 2 through 7 represent the power required when the clearancing piston is set at 6 specific intermediate positions between the extreme maximum and minimum positions.

Similarly to FIG. 6 for the effects on compressor load or required power, FIG. 7 illustrates the corresponding effects of the variable volume clearance pocket on the compressor flow rate. Line 1 represents the compressor flow rate, measured in millions of standard cubic feet per day or MMscfd, when the variable volume clearance pocket is set at its maximum loaded or minimum unloader condition, as characterized by the clearancing piston being at the extreme inward position as shown in FIG. 1A. Line 8 represents the compressor flow rate when the variable volume clearance pocket is set at its minimum loaded or maximum unloader condition, as characterized by the clearancing piston being at the extreme outward position as shown in FIG. 1B. Lines 2 through 7 represent the compressor flow rate when the clearancing piston is set at 6 specific intermediate positions between the extreme maximum and minimum positions.

The device of the invention can be used repeatedly to change the compressor cylinder clearance volume as required or desired to control compressor capacity and power required from the compressor driver. The present invention is typically mounted on the outer or head end of a compressor cylinder, which is generally the optimal location to mount an unloading device. However, compact versions of the present invention may also be located over a compressor suction valve pocket or a special pocket connection located on either end of the compressor cylinder.

The invention can be readily scaled up or down for use on compressors having strokes of between about 1 inches to about 20 inches or more, for cylinders having bore diameters of between about 1 inch to about 48 inches or more, for compression suction pressures of between about negative 14 (−14) psig to about 2000 psig or more, for compression discharge pressure of between about 1 psig to about 4000 psig or more, and for compressing process gases. Process gases can include, but are not limited to, air, natural gas, nitrogen, hydrogen, carbon dioxide, or any other pure gas or combination of gases in any variation, ranging from molecular weight of between about 2.0 to about 60.0 or more.

The present invention, although initially intended for use on the outer head of a reciprocating compressor cylinder, can also be scaled and configured for use in conjunction with a variable clearance volume unloader operating over a compressor valve pocket or a special port in the compressor body.

While the present invention has been illustrated by the description of embodiments and examples thereof, it is not intended to restrict or in any way limit the scope of the appended claims to such detail. Additional advantages and modifications will be readily apparent to those skilled in the art. Accordingly, departures may be made from such details without departing from the scope or spirit of the invention.

What is claimed is:

1. In a reciprocating compressor, a device for varying the clearance volume of a variable volume clearance pocket, the device comprising:

a) a main housing having a gear end and a piston end, and a threaded bore having first threads;

b) a gear housing mounted to the gear end of the main housing, the gear housing including a drive gear;

c) a head mounted to the piston end of the main housing and adapted to sealably fit within the outer end of a reciprocating compressor cylinder, the compressor cylinder including a compressor piston and a variable volume clearance pocket, the clearance pocket formed between the compressor piston and the outer end of the compressor cylinder;

d) a clearancing piston located within the head of the device and adapted to be movable therein, movement of the clearancing piston operable to vary the clearance volume within the compressor cylinder;

e) a threaded stem having a drive engagement end and a piston end, the drive engagement end of the threaded stem having a bore therein, the piston end of the threaded stem rigidly connected to the clearancing piston, wherein the threaded stem is supported and aligned by a sleeve bearing, the threaded stem having second threads on the outer diameter of the threaded stem that engage the first threads of the threaded bore, wherein rotation of the threaded stem and the rigidly connected piston causes the second threads to rotate in the first threads, thereby axially withdrawing or advancing the piston within the head;

f) a telescoping drive shaft having a gear end and a drive engagement end and adapted to be turned by the drive gear, the gear end of the drive shaft attached to the drive gear, the drive engagement end of the drive shaft adapted to drivably engage the bore in the drive engagement end of the threaded stem to rotate the threaded stem and the rigidly connected piston, wherein the drive engagement end of the drive shaft axially slides into or retreats out of the drive engagement end of the threaded stem as the drive shaft is turned by the drive gear thereby causing the threaded stem to rotate;

g) a pressure amplifier configured to amplify pressure from a pressurized fluid source; and h) a pressure-actuated jam nut for biasing the threaded stem in a static position and for unbiasing the threaded stem to allow movement thereof, the jam nut including at least one pressure disc defining a sealed interior region of the jam nut, the interior region configured to accept liquid pressurized by the pressure amplifier, wherein application of the pressurized liquid in the interior region causes the jam nut to lock the threaded stem in a fixed position, wherein when the jam nut is unbiased the threaded stem and the clearancing piston can be rotated to advance axially outward and inward within in the head, and wherein movement of the clearancing piston within the head allows the volume of the clearance pocket to be varied in a controlled manner.

2. The device of claim 1, wherein the drive gear includes a drive motor and a pinion gear and shaft assembly, and wherein the drive shaft is attached near its gear end to the drive motor via the pinion gear and shaft assembly.

3. The device of claim 1, wherein the head is constructed either as a single piece or as an assembly of more than one piece.

4. The device of claim 1, further including a controller programmed to automatically operate the drive motor, and a position encoder for tracking the position of the clearancing piston and providing a feedback signal to the controller.

5. The device of claim 1, wherein rotation of the pressure-actuated jam nut is prevented by at least one anti-rotation pin.

6. The device of claim 1, wherein the device is configured for use either in conjunction with a variable clearance volume unloader operating typically on the outer or head end of a reciprocating compressor cylinder, or over a reciprocating compressor valve pocket or a special port in a reciprocating compressor body.

7. A reciprocating compressor having a controllable variable volume clearance pocket, the compressor comprising:

a) at least one reciprocating compressor cylinder, each of the at least one compressor cylinders including a compressor piston and a variable volume clearance pocket, the clearance pocket formed between the compressor piston and the outer end of the compressor cylinder; and b) a device for varying the clearance volume of the variable volume clearance pocket, the device comprising:

i) a main housing including a gear end and a piston end, and a threaded bore having first threads;

ii) a gear housing mounted to the gear end of the main housing, the gear housing including a drive gear;

iii) a head mounted to the piston end of the main housing and adapted to sealably fit within the outer end of the compressor cylinder;

iv) a clearancing piston located within the head of the device and adapted to be movable therein, movement of the clearancing piston operable to vary the volume of the clearance pocket within the compressor cylinder;

v) a threaded stem having a drive engagement end and a piston end, the drive engagement end of the threaded stem having a bore therein, the piston end of the threaded stem rigidly connected to the clearancing piston, wherein the threaded stem is supported and aligned by a sleeve bearing, the threaded stem having second threads on the outer diameter of the threaded stem that engage the first threads of the threaded bore, wherein rotation of the threaded stem and the rigidly connected piston causes the second threads to rotate in the first threads, thereby axially withdrawing or advancing the piston within the head;

vi) a telescoping drive shaft having a gear end and a drive engagement end and adapted to be turned by the drive gear, the gear end of the drive shaft attached to the drive gear, the drive engagement end of the drive shaft adapted to drivably engage the bore in the drive engagement end of the threaded stem to rotate the threaded stem and the rigidly connected piston, wherein the drive engagement end of the drive shaft axially slides into or retreats out of the bore in the drive engagement end of the threaded stem as the drive shaft is turned by the drive gear, thereby causing the threaded stem to rotate;

vii) a pressure amplifier configured to amplify pressure from a pressurized fluid source; and viii) a pressure-actuated jam nut for locking the threaded stem in a static position and for unlocking the threaded stem to allow movement thereof, wherein the jam nut includes at least one pressure disc defining a sealed interior region of the jam nut, the interior region configured to accept liquid pressurized by the pressure amplifier, wherein application of the pressurized liquid in the interior region causes the jam nut to lock the threaded stem in a fixed position, wherein when the jam nut is unlocked the threaded stem and the clearancing piston can be rotated to advance axially outward and inward within in the head, and wherein movement of the clearancing piston within the head allows the volume of the clearance pocket to be varied in a controlled manner.

8. The reciprocating compressor of claim 7, wherein the drive gear includes a drive motor and a pinion gear and shaft assembly, and wherein the drive shaft is attached near its gear end to the drive motor via the pinion gear and shaft assembly.

9. The reciprocating compressor of claim 7, further including a controller programmed to automatically operate the drive motor, and a position encoder for tracking the position of the clearancing piston and providing a feedback signal to the controller.

10. The reciprocating compressor of claim 7, wherein rotation of the pressure-actuated jam nut is prevented by at least one anti-rotation pin.

11. The reciprocating compressor of claim 7, wherein the device is configured for use either in conjunction with a variable clearance volume unloader operating typically on the outer or head end of a reciprocating compressor cylinder, or over a reciprocating compressor valve pocket or a special port in a reciprocating compressor body.

12. The device of claim 7, wherein the head is constructed as a single piece.

13. The device of claim 7, wherein the head is constructed as an assembly of more than one piece.

14. A reciprocating compressor having a controllable variable volume clearance pocket, the compressor comprising:

a) at least one reciprocating compressor cylinder, each of the at least one compressor cylinders including a compressor piston and a variable volume clearance pocket, the clearance pocket formed between the compressor piston and the outer end of the compressor cylinder; and b) a device for varying the clearance volume of the variable volume clearance pocket, the device comprising:

i) a housing including a gear end, a piston end, and a threaded bore having first threads, the housing including a drive gear;

ii) a head mounted to the piston end of the housing and adapted to sealably fit within the outer end of the compressor cylinder;

iii) a clearancing piston that creates a seal and is movable within the head, movement of the clearancing piston operable to vary the volume of the clearance pocket within the compressor cylinder;

iv) a threaded stem having a drive engagement end and a piston end, the drive engagement end of the threaded stem having a bore therein, the piston end of the threaded stem rigidly connected to the clearancing piston, wherein the threaded stem is supported and aligned by a sleeve bearing, the threaded stem having second threads on the outer diameter of the threaded stem that engage the first threads of the threaded bore, wherein rotation of the threaded stem and the rigidly connected piston causes the second threads to rotate in the first threads, thereby axially withdrawing or advancing the piston within the head;

v) a telescoping drive shaft having a gear end and a drive engagement end and adapted to be turned by the drive gear, the gear end of the drive shaft attached to the drive gear, the drive engagement end of the drive shaft adapted to drivably engage the bore in the drive engagement end of the threaded stem to rotate the threaded stem and the rigidly connected piston, wherein the drive engagement end of the drive shaft axially slides into or retreats out of the drive engagement end of the threaded stem as the drive shaft is turned by the drive gear, thereby causing the threaded stem to rotate;

vi) a pressure amplifier configured to amplify pressure from a pressurized fluid source; and vii) a pressure-actuated jam nut for biasing the threaded stem in a static position and for unbiasing the threaded stem to allow movement thereof, wherein the jam nut includes at least one pressure disc defining a sealed interior region of the jam nut, the interior region configured to accept liquid pressurized by the pressure amplifier, wherein application of the pressurized liquid in the interior region causes the jam nut to lock the threaded stem in a fixed position, wherein when the jam nut is unbiased the threaded stem and the clearancing piston can be rotated to advance axially outward and inward within in the head, and wherein movement of the clearancing piston within the head allows the volume of the clearance pocket to be varied in a controlled manner.

15. The device of claim 1, further comprising a pressure compensation system for changing the pressure behind the clearancing piston, the pressure compensation system including a compensating gas chamber for connecting the space behind the clearancing piston to discharge pressure when the clearancing piston is to be moved inward toward the compressor cylinder and to suction pressure when the clearancing piston is to be moved outward away from the compressor cylinder.

16. The reciprocating compressor of claim 7, wherein device for varying the clearance volume of the variable volume clearance pocket further comprises a pressure compensation system for changing the pressure behind the clearancing piston, the pressure compensation system including a compensating gas chamber for connecting the space behind the clearancing piston to discharge pressure when the clearancing piston is to be moved inward toward the compressor cylinder and to suction pressure when the clearancing piston is to be moved outward away from the compressor cylinder.

* * * * *